United States Patent [19]

Rotondo

[11] Patent Number: 4,887,691

[45] Date of Patent: Dec. 19, 1989

[54] MODULAR WALL CONSTRUCTION USING POSTS AND PANELS

[75] Inventor: Richard J. Rotondo, Sellersville, Pa.

[73] Assignee: Rotondo/Penn-Cast, Telford, Pa.

[21] Appl. No.: 267,388

[22] Filed: Nov. 4, 1988

[51] Int. Cl.[4] ..... E02D 29/02; E04H 17/00

[52] U.S. Cl. ..... 181/210; 181/294; 181/296; 52/144; 52/274; 52/295; 52/722; 248/679; 405/252; 405/257; 405/261; 405/286

[58] Field of Search ..... 181/210, 284; 52/144, 52/145, 155–157, 162, 164, 233, 239, 244, 253, 274, 283, 295–297, 722, 723, 729; 405/251, 252, 257, 260, 261, 272, 284, 286; 248/679, 680

[56] References Cited

U.S. PATENT DOCUMENTS

| | | | |
|---|---|---|---|
| 2,625,815 | 1/1953 | Black | 52/295 X |
| 2,857,755 | 10/1958 | Werth | 52/723 X |
| 3,372,448 | 3/1968 | Weys | 52/722 X |
| 4,452,028 | 6/1984 | Norton et al. | 52/295 X |
| 4,566,558 | 1/1986 | Link, Jr. et al. | 181/210 |
| 4,572,711 | 2/1986 | Benson et al. | 405/286 |
| 4,592,678 | 6/1986 | McNinch, Jr. et al. | 405/284 |
| 4,605,090 | 8/1986 | Melfi | 181/210 |

*Primary Examiner*—B. R. Fuller

[57] ABSTRACT

A post and panel wall system for use as sound barriers and the like utilizes a precast post which is disposed upon a foundation having a tensioning cable extending upwardly therefrom and recesses into which depending anchoring rods on the posts are placed. The tensioning cable is tensioned and then the recesses in the foundation are filled with a cementitious mixture or grout to thoroughly bond the anchoring rods into the foundation. The posts have channels in which the vertical edges of the wall panels are seated, and desirably the wall panels have reduced thickness end portions with arcuate edges to permit some adjustment within the channels. The posts and panels may be erected seriatim, or the posts may initially erected and the panels then lowered into place.

24 Claims, 5 Drawing Sheets

MODULAR WALL CONSTRUCTION USING POSTS AND PANELS

FIELD OF THE INVENTION

This invention relates to a novel concrete post and panel wall system using tensioned posts, and to the method for erecting the same.

BACKGROUND OF THE INVENTION

Some concrete noise barriers employ upright posts having channels on opposite sides thereof to seat the edges of panels of separate wall panels. Such post and panel systems are frequently utilized as noise barriers, i.e., to reduce the noise emanating from highways. Examples of such post and panel systems are disclosed in U.S. Pat. Nos. 4,605,090 and 4,566,558.

Post and panel barrier systems must follow the vertical contour of the land and curves along the highway. Moreover, they must exhibit structural strength sufficient to withstand high winds and impacts, and stresses due to frost heaving. Moreover, there is a need for such wall systems which may be easily and quickly erected and which are flexible for use on grades and where the post and panel system must turn to follow a predetermined path.

Accordingly, it is an object of the present invention to provide a new and improved post and panel wall system which may be easily erected and which includes a new and improved post construction affording early high post strength to facilitate rapid placement of posts and panels.

It is also an object to provide such a wall system which is relatively economical to fabricate.

Another object is to provide a relatively simple and rapid method for erecting such wall systems.

SUMMARY OF THE INVENTION

It has now been found that the foregoing and related objects and advantages may be readily attained in a post and panel wall system which utilizes a post structure comprising a concrete foundation having a plurality of horizontally spaced, vertically extending cavities opening at the top of the foundation, and a tensioning cable embedded therein and extending upwardly therefrom intermediate the cavities.

On this foundation is a vertically elongated precast concrete post having a plurality of anchoring rods depending from the bottom end thereof and positioned in the cavities of the foundation. The post has channels on opposed vertical sides thereof adapted to receive the vertical edges of associated wall panels, and it also has a passage extending horizontally therethrough at a point spaced from the bottom end thereof. In the post is a second passage extending vertically from the horizontal passage to the bottom end of the post, and the cable of the foundation extends upwardly through the vertical passage to the horizontal passage. The cable is tensioned, and disposed on the cable in the horizontal passage is tension retaining means to retain the cable in tension. A cementitious material such as grout is disposed in the foundation cavities about the anchoring rods to firmly secure the anchoring rods in the foundation.

In the preferred embodiment, the post has a horizontally extending recess in the bottom end thereof, and the post is of generally H-shaped cross section defined by a pair of legs and a web. The anchoring rods extend vertically within the legs and the tensioning cable extends within the web. The horizontally extending cavity is disposed in the web at the bottom end of the post.

Desirably, there is included a bearing pad intermediate the foundation and the post, and this pad is fabricated from an elastomeric composition. Conveniently, the cavities in the foundation are defined by cylindrical cannisters.

The assembled post and panel wall construction has a multiplicity of the spaced apart post structures, and a multiplicity of wall panels extending horizontally between pairs of post structures and having their ends seated in the vertically extending channels thereof. These wall panels desirably have reduced thickness end portions with arcuate edges which seat in the channels and cooperate with the arcuate base surface thereof.

In the method of constructing the post for the post and panel wall system, a hole is excavated for the foundation, and a concrete foundation is formed in the hole. The vertically elongated precast concrete post is positioned on the foundation with the rods extending into the foundation cavities and the cable extending upwardly through the vertical passage to the horizontal passage. The cable is then tensioned by tensioning means disposed within the horizontal passage of the post, and the cable is retained in tension by tension retaining means disposed thereon within the horizontal passage. A cementitious material is injected into the foundation cavities about the anchoring rods to secure the anchoring rods in the foundation.

Generally, pairs of horizontally spaced post structures are erected, and the wall panels are lowered so that their ends seat in the channels of the spaced posts.

BRIEF DESCRIPTION OF THE DRAWINGS

FIGS. **9*a*–13*a* are top plan views of the posts of FIGS. 9–13, respectively.

DETAILED DESCRIPTION OF PREFERRED EMBODIMENTS OF THE INVENTION

Figure 1:
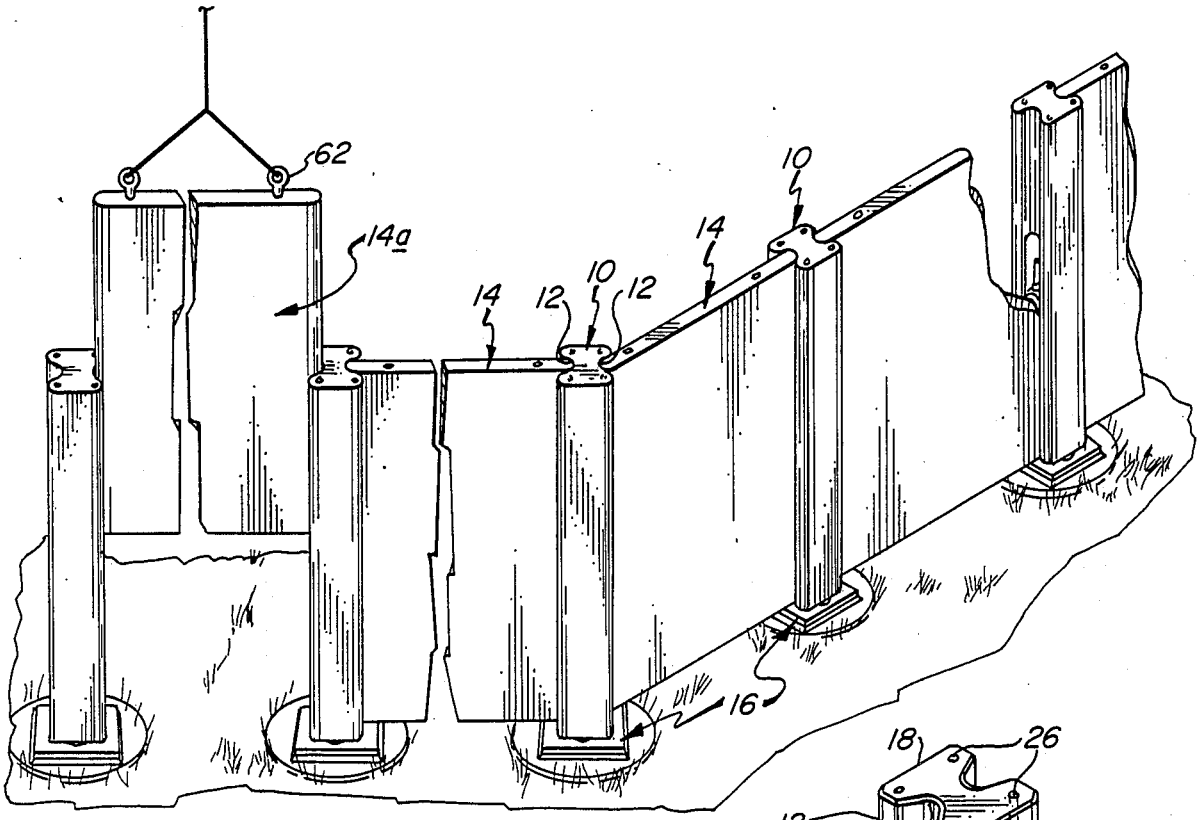
FIG. 1 is a perspective view of a partially assembled wall embodying the post and panel system of the present invention with a fragmentarily illustrated wall panel being lowered into position and with a portion of a wall panel broken away.

Turning first to FIG. 1 of the drawings, a wall system embodying the post and panel construction of the present invention comprises a plurality of concrete posts generally designated by the numeral 10 which have which have vertical channels 12 along their opposed sides seating therein the vertical edges of wall panels generally designated by the numeral 14. As shown, four panels 14 have been set in place, and the leftmost panel 14a is being lowered into position by a crane or the like (not shown). The posts 10 are set on concrete foundations generally designated by the numeral 16.

Figure 3:
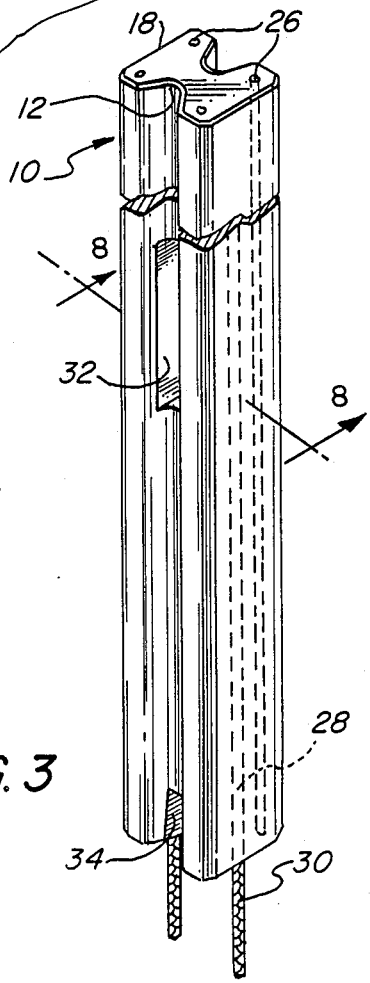
FIG. 3 is a fragmentary perspective view of a precast post of FIG. 1 to an enlarged scale.
Figure 4:
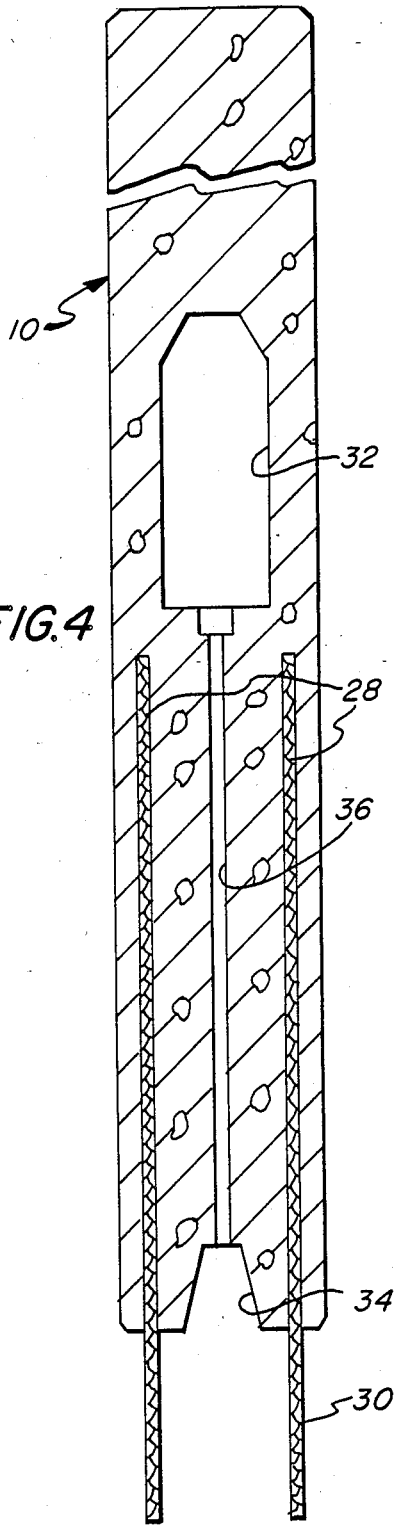
FIG. 4 is a fragmentary sectional view in elevation of the post of FIG. 3 and drawn to an enlarged scale.

Turning first in detail to the structure of the posts 10 as seen in FIGS. 3 and 4, they are of precast concrete with H-shaped cross section defined by a pair of legs or wide sections 18 and a relatively narrow connecting web 20 produced by the channels 12. Extending in each of the legs 18 is at least one pair of steel reinforcing rods 26, and these extend upwardly throughout substantially the entire height of the post 10. Also disposed within the leg portions are anchoring bars 28 which extend upwardly a substantial portion of the height of the posts 10 and which have a portion 30 extending downwardly from the lower end of the post 10.

Spaced upwardly from the lower end of the post 10 is a blockout or horizontal passage 32 which extends through the web 20, for a purpose to be described hereinafter. The post 10 also has a horizontally extending recess 34 in the web 20 at its lower end, and a vertical passage 36 extends therebetween.

Figure 2:
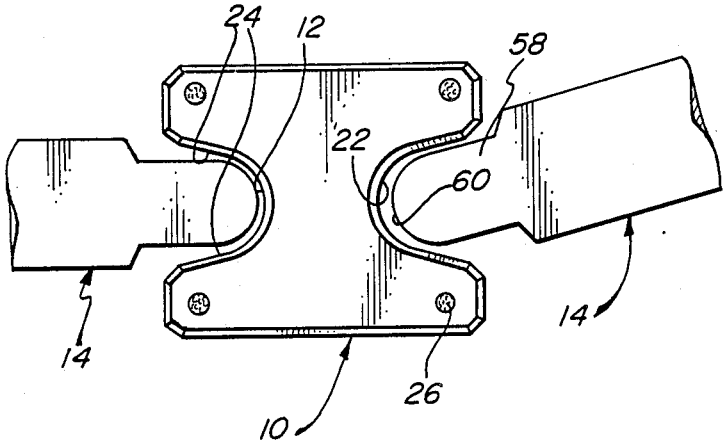
FIG. 2 is a fragmentary plan view of a portion of the wall of FIG. 2 drawn to an enlarged scale.

As best seen in FIG. 2, the channels 12 have an arcuate base portion 22 and generally rectilinear and diverging side portions 24.

Figure 5:
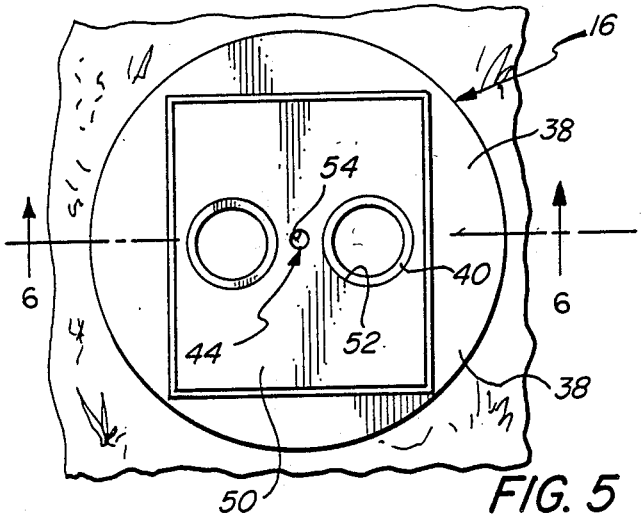
FIG. 5 is a plan view of a foundation which has been prepared for mounting the post shown in FIGS. 3 and 4 and drawn to an enlarged scale.
Figure 6:
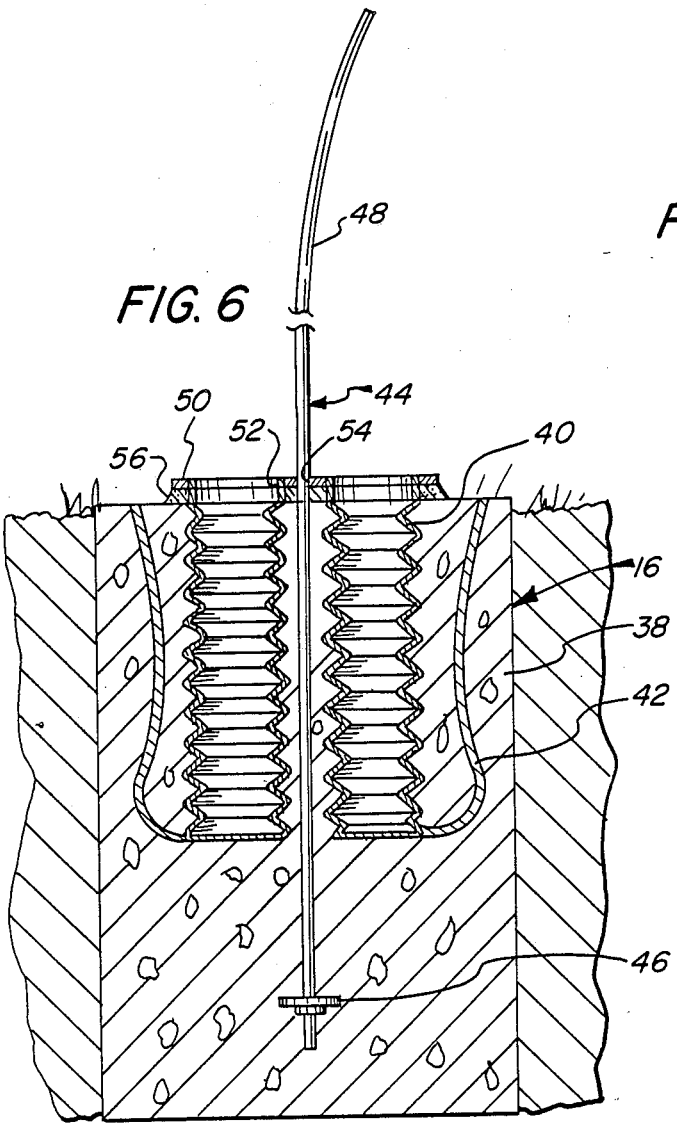
FIG. 6 s a fragmentary sectional view in along the line 6—6 of FIG. 5 and drawn to an enlarged scale.

Turning now in detail to the foundation 16 as seen in FIGS. 5 and 6, concrete is poured into an excavation to provide the base 38. As the concrete is being poured, corrugated metal cannisters 40 are disposed therein and have grout tubes 42 extending upwardly from the bottom thereof to the top of the base 38. In addition, a galvanized stranded cable generally designated by the numeral 44 with an anchor 46 adjacent its lower end is disposed within the concrete and has an upwardly projecting portion 48.

A bearing pad generally designated by the numeral 50 and of an elastomeric composition is placed upon the upper surface of the base 38 and is conveniently provided with apertures 52, 54 aligned with the cannisters 40 and cable 44, respectively. Desirably, an intermediate grout pad 56 is also employed.

Turning now to the wall panels 14, these are generally of reinforced concrete construction and have vertically extending end portions 58 of reduced thickness with edge surfaces 60 of arcuate cross section so as to facilitate angular orientation and movement within the channels 12 of the posts 10, as may best be seen in FIG. 2. Conveniently, the panels 14 are precast with lifting eyes 62 along their upper edges to facilitate their transport and placement as seen in FIG. 1.

Figure 8:
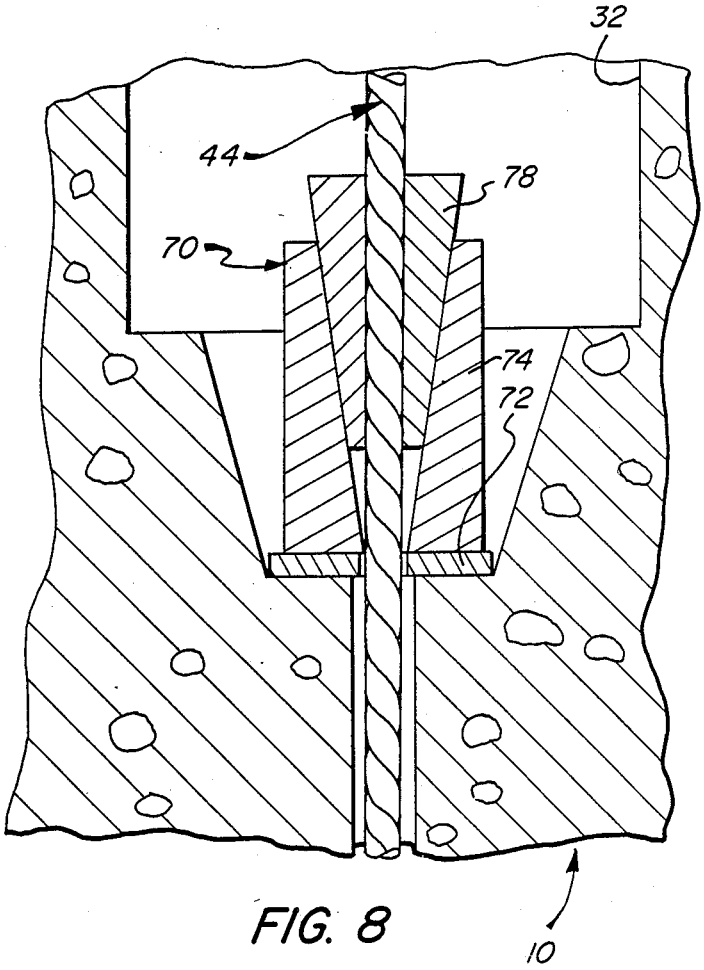
FIG. 8 an enlarged fragmentary sectional view of the post assembly portion of FIG. 7 along the line 8—8 of FIG. 3.
Figure 7:
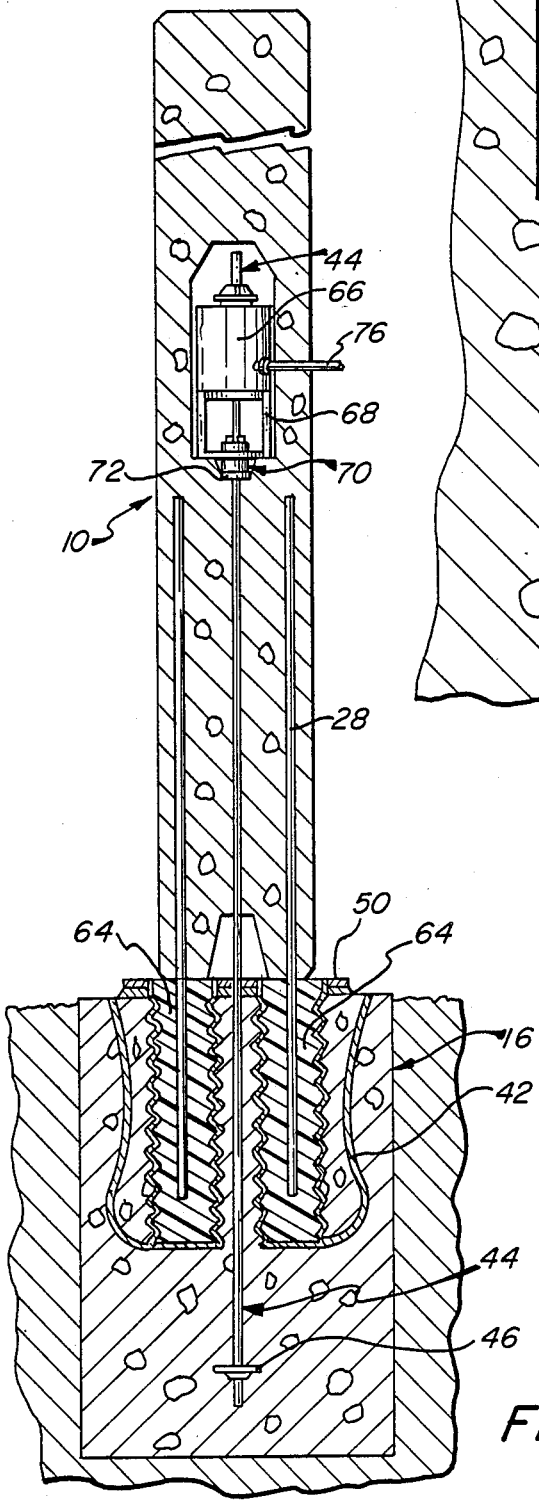
FIG. 7 is a fragmentary sectional view of a post as mounted upon a foundation and showing the tensioning mechanism applied thereon.
Figure 13A:
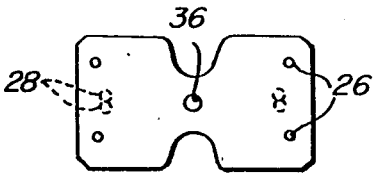
FIGS. 9–13 are fragmentary side elevational views of various post configurations utilized in the wall systems of the invention.
Figure 13:
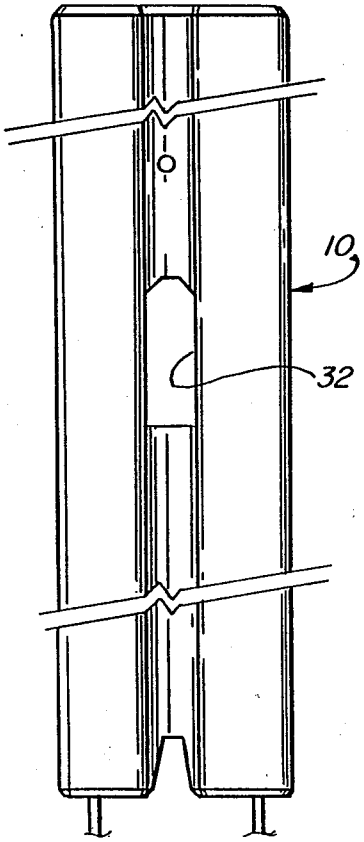
Figure 12A:
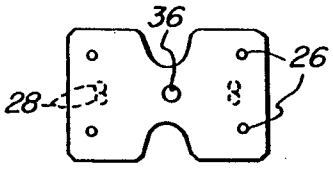
Figure 12:
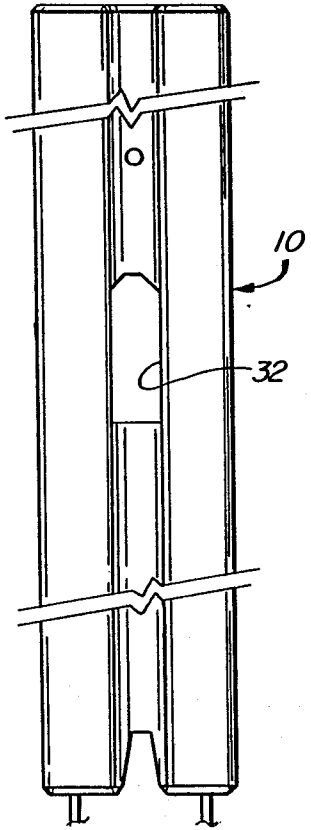
Figure 11A:
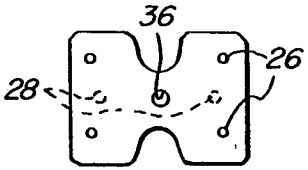
Figure 11:
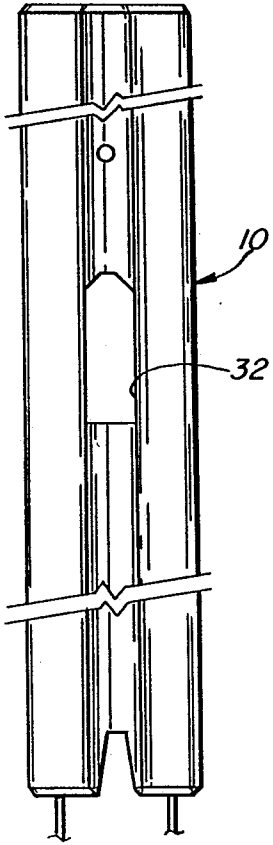
Figure 10A:
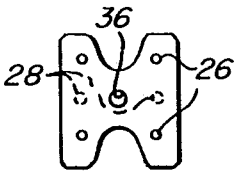
Figure 10:
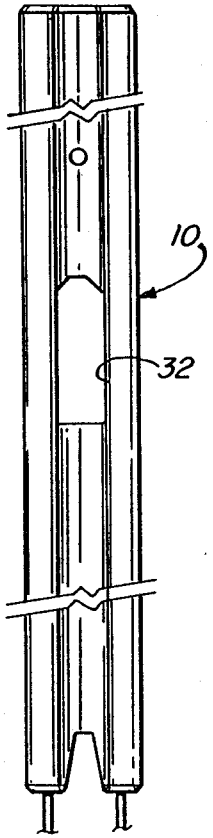

In the finished post structure seen in FIGS. 7 and 8, the post 10 seats upon the bearing pad 50 with the anchoring bars 26 extending into the cannisters 40. The cable 44 extends upwardly through passage 36 into the blockout 32. Grout 64 fills the cannisters 40 to firmly bond the anchoring bars 26 to the foundation 16.

As seen in FIG. 7, the upper end of cable 44 is shown as disposed within a hydraulic jack 66 which rests upon the lower surface of the blockout 32. The jack 66 is supported on legs 68 which provide clearance under its body portion.

As best seen in FIG. 8, the cable 44 first passes through a chuck assembly generally designated by the numeral 70 which has a base plate 72 resting on the base surface of blockout 32 and an upright portion 74 with an internal frustro-conical surface. After the jack 66 is operated by hydraulic fluid introduced through conduit 76 to tension the cable 44, conical surface wedges 78 are driven into the chuck upright portion 74 to anchor the tensioned cable 44. This firmly secures the post 10 to foundation 16.

After the cable 44 has been tensioned and anchored, the hydraulic pressure may be released in the jack 66, and the jack 66 may be removed from blockout 32. Then the blockout 32 is completely filled with a foam filler, sealing the chuck and wedges therein.

In the process of erecting the illustrated embodiment, a series of excavations are made at the site at locations which are appropriately spaced. Conveniently, paper tubes or the like (not shown) may be placed in the excavations to provide a mold into which the concrete is poured. As the concrete is being poured, the cannisters 40 with their grout tubes 42 and the galvanized cable 44 are placed therein. The surface of the concrete is leveled, or inclined, depending upon the grade angle.

After the concrete has set to a predetermined minimum strength, the construction may continue. The bearing pad 50 is placed upon the base 38 and may be shimmed to fine tune the angle and elevation for its upper surface with the grout pad 56 providing full support therefor. The post 10 is then lowered onto the foundation 16 with the cable 44 being guided upwardly through the passage 36 and the anchoring bars 28 being introduced into the cannisters 40.

After the post 10 has been set in place, the chuck assembly 70 and jack 66 are placed on the cable 44 in the blockout 32, and the cable 44 is tensioned to a predetermined level. The wedges 78 are driven into the chuck upright portion to lock the tensioned cable 44 if no further tensioning is contemplated, and the jack 66 is removed.

At this point, the post 10 may still be rotationally adjusted on the foundation 16. Next, grout 64 is injected through grout tubes 42 to fill the interior of cannisters 40 and thereby secure anchoring rods 28 therein. When the grout 64 cures in the cannisters 40, an essentially monolithic structure is provided. The cable 44 securely holds the post 10 in the vertical position, while the grout cures about the anchoring rods 28.

It will be noted that there is a blockout or recess 34 extending laterally through the post 10 at the bottom end thereof and defining two short legs. Even after initial tensioning of cable 44, some adjustment upon the foundation 16 is facilitated by the clearance about the cable 44 as it exits the foundation 16. This accommodates minor adjustments laterally for the foundation to provide the necessary center to center distance between adjacent posts.

After a pair of posts 10 has been initially tensioned, a wall panel 14 may be lowered into place as shown in FIG. 1. However, the versatility of the posts 10 of the present invention allows erection of posts and wall panels seriatim, although this requires stabilization of the wall panel 14 until the remote post 10 is tensioned to provide firm support therefor.

Since access to the cable 44 is available from either side of the post 10 through blockout 32, the erecting contractor has the option of tensioning the strand to its designed load immediately, or delaying final tensioning until the wall panels 14 have been set since the jack and chuck may be manipulated from either side of the post 10. After the cable 44 has been fully tensioned, the post 10 is sufficiently securely positioned to allow other work to be completed. This provides the erecting contractor the option of grouting the cannisters 40 before or after all the posts 10 and panels 14 have been set.

As will be appreciated, the reduced end portions 58 of the panels 14 with their arcuate edge surfaces 60 cooperate with the arcuate surfaces 22 of the channels 12 of the posts 10 to facilitate sliding of the panels 14 into the posts 10 and to enable facile erection of a non-rectilinear wall system as well as to accommodate misalignment.

Turning now to FIGS. 9–13 and **9*a*–13*a*, these illustrate the various size posts 10 which may be utilized. In the larger posts, as shown in FIGS. 12 and 13 and 12*a* and 13*a*, a pair of anchoring bars 28 may be utilized in each leg 18 of the posts 10**.

Figure 9A:
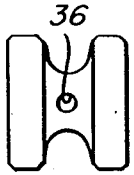
Figure 9:
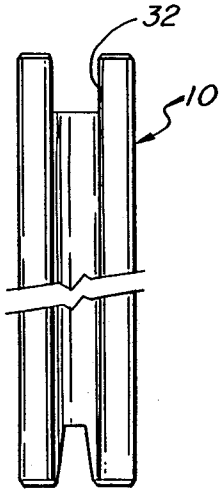

As shown in FIG. 9 and FIG. **9*a*, a shorter post may require no anchoring bars since the cable may provide sufficient strength to the post structure, and the blockout 32 may be provided at the top of the post 10**.

Figure 14:
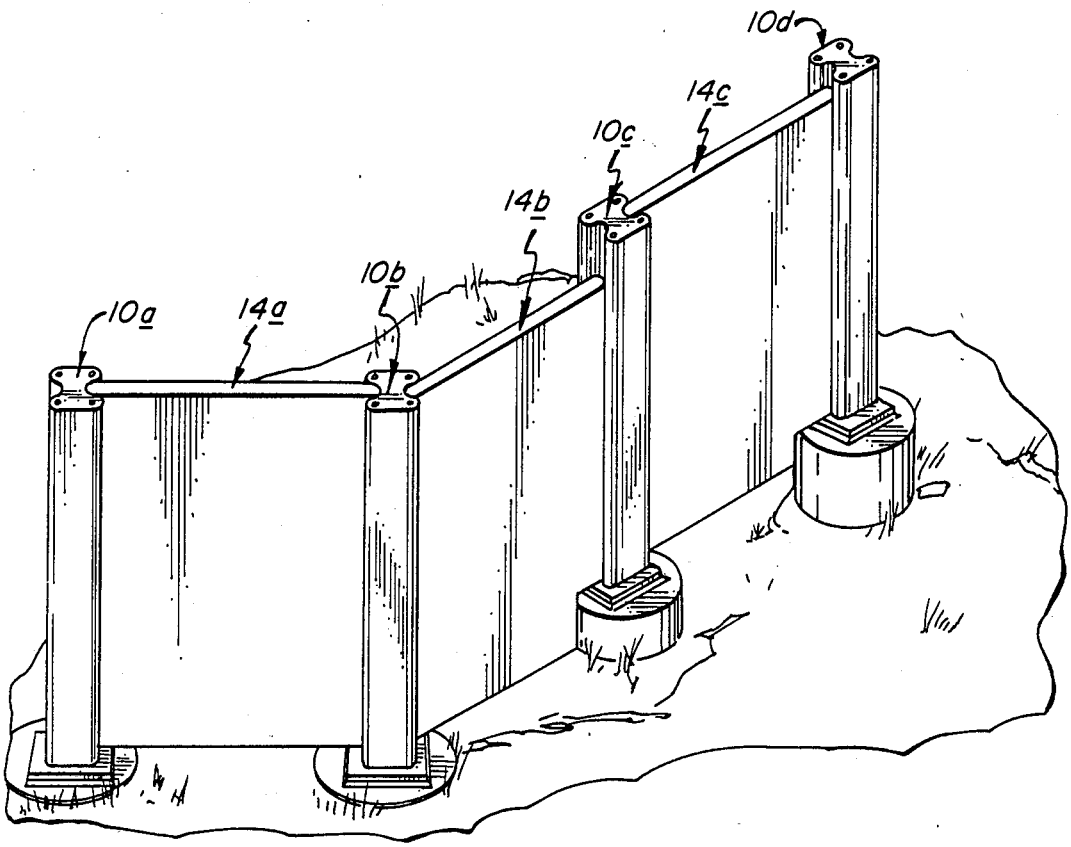
FIG. 14 is a perspective view similar to FIG. 1** showing a portion of a wall installation embodying the invention as installed on a grade.

In FIG. 14, the versatility of the wall system of the invention is shown in a wall installed on a grade. The posts **10*a* and 10*b* are set at the same elevation and receive the wall panel 14*a* therebetween. The posts 10*c* and 10*d* are set at successively higher elevations. The panel 14*b* is received between the posts 10*b* and 10*c*, and the panel 14*c* is received between posts 10*c* and 10*d*. The lower corners at the upper ends of the panels 14*c* and 14*d* are notched to accommodate the increasing grade. However, the panels 14** could be cast with lower edges at an angle corresponding to the grade. In all cases, the wall panel is supported upon the foundation of the post structures.

Generally, the foundations for the post structures will contain as reinforcing four #6 vertical bars and two #3 stirrups spaced 24" apart at the top. A template is used to approximate the top elevations for the cannisters, to locate the galvanized strand and to locate the upper ends of the two grout tubes. The foundations should utilize concrete which has a minimum strength of 3,000 p.s.i. at 28 days. The bearing pad is desirably placed upon a grout pad to establish the final elevations and to level the surface, or to provide a desired angularity.

After the post has been set in place, the chuck and wedges are slid onto the cable in the blockout and then the jack and anchor are placed thereon. The cable is normally tensioned to initial force of 28,900 pounds, although variations may be desirable for some installation. The wedges are then seated in the chuck, the tension released upon the jack, and the jack removed. At some point after the tensioning has taken place and no further tensioning is required, the blockout is filled with a foam which is desirably polyurethane or other resin providing good weathering characteristics.

The grout or cementitous mixture which is used to fill the cannister should be a non-shrinking type which rapidly develops high strength and which has a minimum strength of 4,500 p.s.i. at 28 days.

As will be readily appreciated, the wall panels are reinforced precast structures which are desirably provided with suitable surface finish from the standpoint of aesthetics, and weatherability.

The following tables set forth optimum values for the elements of the post structure depending upon size of the posts required.

TABLE 1

| Post Height | | Bearing Pad Size | | Corrugated Metal Cans | |
|---|---|---|---|---|---|
| Min. (Ft.) | Max. (Ft.) | Width (in.) | Depth (in.) | Depth (in.) | Total Spacing (in.) |
| 0.0 | 5.5 | 15 | 13 | — | — |
| 5.5 | 10.0 | 15 | 13 | 20 | 8 |
| 10.0 | 16.0 | 15 | 19 | 26 | 12 |
| 16.0 | 18.0 | 15 | 21 | 26 | 14 |
| 18.0 | 26.0 | 15 | 25 | 31 | 18 |

TABLE 2

| Post Ht. | | Post Size | | Post Reinforc'g | | Anchor | | Embedment | | *Foundation Size | |
|---|---|---|---|---|---|---|---|---|---|---|---|
| Min. (ft) | Max. (ft) | Width (in) | Depth (in) | Total No. of | Bar Size (#) | No. Each Side | Bar Size (#) | Depth Fnd. | In Post | Dia. (ft) | Ht. (ft) |
| 0.0 | 5.5 | 14 | 12 | 2 | 5 | — | — | — | — | 2.0 | 6.0 |
| 5.5 | 10.0 | 14 | 12 | 4 | 4 | 1 | 7 | 1.5 | 4.0 | 2.0 | 7.0 |
| 10.0 | 16.0 | 14 | 18 | 4 | 5 | 1 | 9 | 2.0 | 8.0 | 2.5 | 8.0 |
| 16.0 | 18.0 | 14 | 20 | 4 | 5 | 2 | 8 | 2.0 | 8.0 | 2.5 | 8.5 |
| 18.0 | 26.0 | 14 | 24 | 4 | 6 | 2 | 10 | 2.5 | 13.5 | 2.5 | 10.0 |

*Foundation size is based on a Type 4 condition

Thus, it can be seen from the foregoing detailed description and the attached drawings that the post and panel system of the present invention is one which may be erected readily utilizing precast structural members to provide a rugged wall system. The present elements may be economically fabricated, and assembled in a manner which enables versatility in design and placement.

Having thus described the invention, what is claimed is:

1. In a post structure for a post and panel wall system in which vertical side edges of panels are seated in channels in posts, the combination comprising:

(a) a concrete foundation having a top surface and a plurality of horizontally spaced, vertically extending cavities opening at the top surface of said foundation, and a tensioning cable embedded therein and extending upwardly therefrom intermediate said cavities;

(b) a vertically elongated precast concrete post having a top end, bottom end and sides, said post also having a plurality of anchoring rods depending from said bottom end thereof and positioned in said cavities of said foundation, said post having channels on opposite sides thereof adapted to receive the vertical side edges of associated panels, said post having a passage extending horizontally therethrough at a point spaced from said bottom end thereof and a second passage extending vertically from said horizontal passage to said bottom end of said post, said cable of said foundation extending upwardly through said vertical passage to said horizontal passage;

(c) tensioning means on said cable in said horizontal passage to retain said cable in tension; and (d) a cementitious material in said foundation cavities about said anchoring rods to firmly secure said anchoring rods in said foundation.

2. The post structure of claim 1 wherein said post has a horizontally extending recess in said bottom end thereof.

3. The post structure of claim 1 wherein said post is of generally H-shaped cross section defined by a pair of legs and a web, and said anchoring rods extend vertically within said legs and said tensioning cable extends within said web.

4. The post structure of claim 3 wherein said post has a horizontally extending cavity in said web at said bottom end of said post.

5. The post structure of claim 1 wherein there is included a bearing pad intermediate said foundation and said post.

6. The post structure of claim 5 wherein said pad is fabricated from an elastomeric composition.

7. The post structure of claim 1 wherein said cavities in said foundation are defined by cylindrical cannisters.

8. In a post and panel wall construction in which vertical side edges of panels are seated in channels in posts, the combination comprising:

(a) a multiplicity of spaced apart post structures each comprising:

(i) a concrete foundation having a top surface and a plurality of horizontally spaced, vertically extending cavities opening at the top surface of said foundation, and a tensioning cable embedded therein and extending upwardly therefrom intermediate said cavities;

(ii) a vertically elongated precast concrete post having a top end, bottom end and sides, said post also having a plurality of anchoring rods depending from said bottom end thereof and positioned in said cavities of said foundation, said post having vertically extending channels on opposite sides thereof each adapted to receive the vertical edge of an associated panel, said post having a passage extending horizontally therethrough at a point spaced from said bottom end thereof and a second passage extending vertically from said horizontal passage to said bottom end of said post, said cable of said foundation extending upwardly through said vertical passage to said horizontal passage;

(iii) tensioning means on said cable in said horizontal passage to retain said cable in tension; and (iv) a cementitious material in said foundation cavities about said anchoring rods to firmly anchor said anchoring rods in said foundation; and (b) a multiplicity of wall panels each having vertical side edges at ends there of and extending horizontally between a pair of post structures, said ends of said panels being seated in said vertically extending channels of said posts.

9. The post and panel wall construction of claim 8 wherein said wall panels have reduced end portions of reduced width seated within said channels.

10. The post and panel wall construction of claim 9 wherein said reduced end portions have arcuate edges and wherein said channels have arcuate base portions.

11. The post and panel wall construction of claim 8 wherein said post has a horizontally extending recess in said bottom end thereof.

12. The post and panel wall construction of claim 8 wherein said post is of generally H-shaped cross section defined by a pair of legs and a web and said anchoring rods extend vertically within said legs and said tensioning cable extends within said web.

13. The post and panel wall construction of claim 12 wherein said post has a horizontally extending cavity in said web at said bottom end of said post.

14. The post and panel wall construction of claim 8 wherein there is included a bearing pad intermediate said foundation and said post.

15. The post and panel wall construction of claim 14 wherein said pad is fabricated from an elastomeric composition.

16. The post and panel wall construction of claim 8 wherein said cavities in said foundation are defined by cylindrical cannisters.

17. In a method of constructing a post structure for a post and panel wall system in which vertical side edges of panels are seated in channels in posts, the steps comprising:

(a) excavating a hole for a foundation;

(b) forming a concrete foundation in said hole with a top surface, said foundation having a plurality of horizontally spaced, vertically extending cavities opening at said top surface of said foundation and a tensioning cable embedded therein and extending upwardly therefrom intermediate said cavities;

(b) providing a vertically elongated precast concrete post having a top end, bottom end and sides, said post also having a plurality of anchoring rods depending from said bottom end thereof, said post having vertically extending channels on opposite sides thereof adapted to receive the vertical edges of associated panels, said post having a passage extending horizontally therethrough at a point spaced from said bottom end thereof and a second passage extending vertically from said passage to said bottom end of said post, said cable of said foundation extending upwardly through said longitudinal channel to said passage;

(c) positioning said post on said foundation with said rods extending into said foundation cavities and said cable extending upwardly through said vertical passage to said horizontal passage;

(d) tensioning said cable by tensioning means disposed within said horizontal passage of said post, and retaining said cable in tension by tension retaining means; and (e) injecting a cementitious material into said foundation cavities about said anchoring rods to secure said anchoring rods in said foundation.

18. The method of claim 17 wherein steps (a)-(e) are repeated to produce a second post structure at a point horizontally spaced from the first post structure and including the further steps of providing a wall panel and inserting the ends of said panel into the channels of said spaced posts.

19. The method of claim 17 wherein each of said post is cast with a horizontally extending recess in said bottom end thereof.

20. The method of claim 17 wherein each of said posts is cast with generally H-shaped cross section defined by a pair of legs and a web, and said anchoring rods extend vertically within said legs and said tensioning cable extends within said web.

21. The method of claim 20 wherein said post is cast with horizontally extending cavity in said web at said bottom end of said post.

22. The method of claim 17 wherein there is included the step of placing a bearing pad intermediate said foundation and said post.

23. The method of claim 22 wherein said pad is molded from an elastomeric composition.

24. The method of claim 17 wherein said cavities in said foundation are defined by cylindrical cannisters during said step of forming said foundation.

* * * * *